United States Patent [19]

Peppiatt

[11] Patent Number: 4,877,336

[45] Date of Patent: Oct. 31, 1989

[54] BOTTOM LOADED DUPLEX BAG HAVING A HANDLE AND METHOD OF MAKING SAME

[75] Inventor: Harry R. Peppiatt, Doylestown, Pa.

[73] Assignee: Paramount Packaging Corporation, Chalfont, Pa.

[21] Appl. No.: 320,845

[22] Filed: Mar. 6, 1989

Related U.S. Application Data

[63] Continuation of Ser. No. 3,110, Jan. 14, 1987, abandoned, which is a continuation-in-part of Ser. No. 821,561, Jan. 21, 1986, Pat. No. 4,713,839, which is a continuation-in-part of Ser. No. 388,381, Jun. 14, 1982, Pat. No. 4,573,203.

[51] Int. Cl.[4] ..... B65C 30/00

[52] U.S. Cl. ..... 383/8; 383/109; 383/120; 383/63

[58] Field of Search ..... 383/8, 120, 107, 109, 383/63, 104

[56] References Cited

U.S. PATENT DOCUMENTS

| | | | |
|---|---|---|---|
| Re. 25,966 | 2/1966 | Wilcox . | |
| 351,378 | 10/1886 | Hill | 383/42 |
| 424,411 | 3/1890 | Fielder | 383/24 |
| 1,808,375 | 6/1931 | Plooster | 383/8 |
| 1,910,789 | 5/1933 | Brady . | |
| 2,021,787 | 11/1935 | Janowitz | 229/52 |
| 2,603,407 | 7/1952 | Crary | 229/54 |
| 2,603,409 | 7/1952 | Crary | 229/54 |
| 2,693,836 | 11/1954 | Hayes | 150/3 |
| 2,722,367 | 11/1955 | Verlin | 229/54 |
| 2,729,150 | 1/1956 | Gelbcke | 93/35 |
| 2,745,593 | 5/1956 | Brady | 229/54 |
| 2,978,769 | 4/1961 | Harrah | 24/201 |
| 3,065,845 | 11/1962 | Nichols | 206/7 |
| 3,066,845 | 12/1962 | Mattaway | 229/55 |
| 3,078,895 | 2/1963 | Silver | 150/1 |
| 3,140,038 | 7/1964 | Laguerre | 229/54 |
| 3,145,708 | 8/1964 | Smith | 383/109 |
| 3,181,583 | 5/1965 | Lingenfelter | 150/3 |
| 3,206,104 | 9/1965 | Cohen | 229/52 |

(List continued on next page.)

FOREIGN PATENT DOCUMENTS

| | | | |
|---|---|---|---|
| 507869 | 11/1954 | Canada . | |
| 1922955 | of 0000 | Fed. Rep. of Germany . | |
| 1967615 | 6/1967 | Fed. Rep. of Germany . | |
| 2155091 | 5/1972 | Fed. Rep. of Germany . | |
| 2811219 | 9/1979 | Fed. Rep. of Germany . | |
| 3321341 | 12/1983 | Fed. Rep. of Germany . | |
| 1262658 | 4/1961 | France . | |
| 1363090 | 12/1964 | France . | |
| 1551228 | 12/1968 | France . | |
| 632707 | 12/1949 | United Kingdom . | |
| 878107 | 9/1961 | United Kingdom | 383/29 |
| 1022595 | 3/1966 | United Kingdom . | |
| 2131392 | 9/1984 | United Kingdom . | |

OTHER PUBLICATIONS

Packaging Digest, Apr. 1981.
Paper, Film & Foil Converter, Apr. 1981.
Package Engineering, Apr. 1981, p. 82.

*Primary Examiner*—Willis Little
*Attorney, Agent, or Firm*—Schwarze, Jacobs and Nadel Panitch

[57] ABSTRACT

The present invention is directed to a duplex bag having a handle. The bag includes an inner and outer web of thermal plastic material. The outer web includes a front panel, a rear panel and a handle portion. The handle portion is integral with the front and rear panels and has a width less than the width of the front and rear panels. The inner web includes a top panel, a bottom panel and a gusset portion. The gusset portion is integral with the top and bottom panels and has a line of perforations spaced from and parallel to the top and bottom panels. All panels have about the same dimensions. The handle portion and the gusset portion are adjacent one another at a top end of the bag. The front panel overlies the top panel and the rear panel overlies the bottom panel. A side seam is formed at each lateral edge portion of said front, top, bottom, and rear panels and seals the panels together.

25 Claims, 3 Drawing Sheets

U.S. PATENT DOCUMENTS

| | | | |
|---|---|---|---|
| 3,208,492 | 9/1965 | Braithwaite | 150/12 |
| 3,240,420 | 3/1966 | Membrino | 229/54 |
| 3,282,173 | 11/1966 | Davis, Jr. et al. | 493/11 |
| 3,282,493 | 11/1966 | Kamins et al. | 229/54 |
| 3,283,994 | 11/1966 | Miller | 229/55 |
| 3,339,606 | 9/1967 | Kugler | 150/3 |
| 3,358,904 | 12/1967 | Van Houtte | 229/54 |
| 3,370,630 | 2/1968 | Haugh et al. | 150/12 |
| 3,372,857 | 3/1968 | Brayla | 229/53 |
| 3,402,749 | 9/1968 | Kinzler | 150/3 |
| 3,462,068 | 8/1969 | Suominen | 229/54 |
| 3,471,871 | 10/1969 | Nociti et al. | 4/142 |
| 3,473,589 | 10/1969 | Gotz | 150/3 |
| 3,481,051 | 12/1969 | Davis, Jr. | 34/162 |
| 3,486,683 | 12/1969 | Kamins et al. | 229/54 |
| 3,490,681 | 1/1970 | Niemeyer | 229/54 |
| 3,490,682 | 1/1970 | Schwarzkopf | 229/54 |
| 3,497,130 | 2/1970 | Stahl | 229/54 |
| 3,506,048 | 4/1970 | Jortikka | 150/1.7 |
| 3,514,033 | 5/1970 | Goodwin | 229/54 |
| 3,520,470 | 7/1970 | Korn et al. | 229/54 |
| 3,554,435 | 1/1971 | Martinez | 229/55 |
| 3,567,110 | 3/1971 | Susuki | 229/54 |
| 3,568,918 | 3/1971 | Blomquist | 383/109 |
| 3,580,486 | 5/1971 | Kugler | 229/54 |
| 3,610,516 | 10/1971 | Joseph | 229/53 |
| 3,640,450 | 2/1972 | Lieberman | 229/53 |
| 3,693,785 | 9/1972 | Sincavage et al. | 206/55 AA |
| 3,721,383 | 3/1973 | Dufes | 229/63 |
| 3,738,567 | 6/1973 | Ruda | 229/62 |
| 3,738,568 | 6/1973 | Ruda | 229/62 |
| 3,746,215 | 7/1973 | Ausnit et al. | 222/92 |
| 3,827,472 | 8/1974 | Uramoto | 150/3 |
| 3,858,789 | 1/1975 | Verbeke | 229/62 |
| 3,966,524 | 6/1976 | Lehmacher | 156/182 |
| 3,982,687 | 9/1976 | Aver et al. | 229/62 |
| 3,991,801 | 11/1976 | Ausnit | 150/3 |
| 4,041,851 | 8/1977 | Jentsch | 383/107 |
| 4,078,659 | 3/1978 | Rensner | 206/432 |
| 4,148,431 | 4/1979 | Lepisto | 229/54 R |
| 4,165,832 | 8/1979 | Kuklies et al. | 229/54 R |
| 4,191,230 | 3/1980 | Ausnit | 150/3 |
| 4,235,653 | 11/1980 | Ausnit | 156/91 |
| 4,252,269 | 2/1981 | Peppiatt | 229/54 |
| 4,285,376 | 8/1981 | Ausnit | 150/3 |
| 4,539,705 | 2/1986 | Murphy | 221/34 |
| 4,550,437 | 10/1985 | Peppiatt et al. | 383/120 |
| 4,573,203 | 2/1986 | Peppiatt | 383/8 |
| 4,682,366 | 7/1987 | Ausnit et al. | 383/65 |
| 4,713,839 | 12/1987 | Peppiatt | 383/29 |

FIG. 1
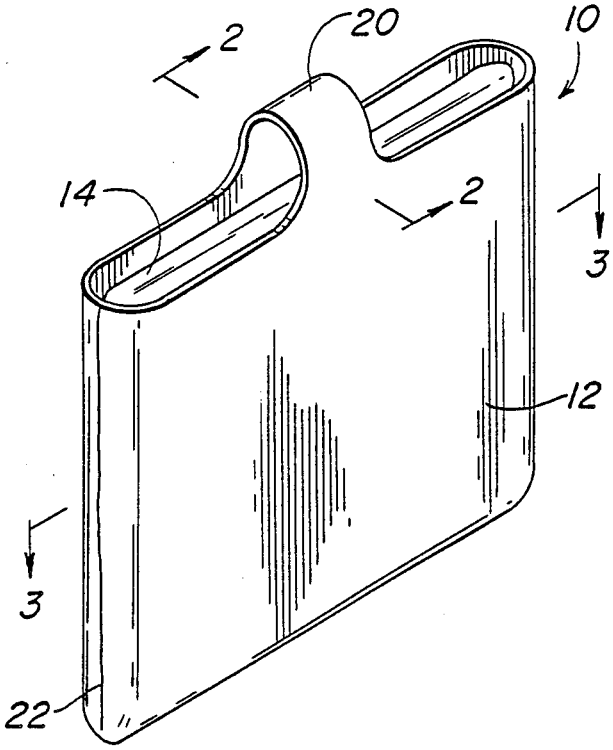
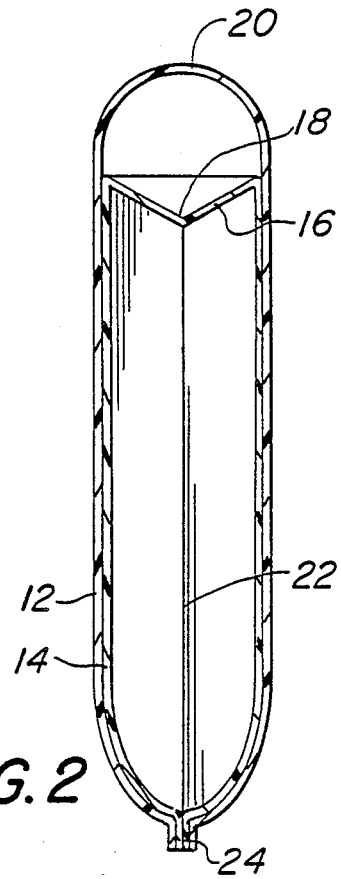
FIG. 2
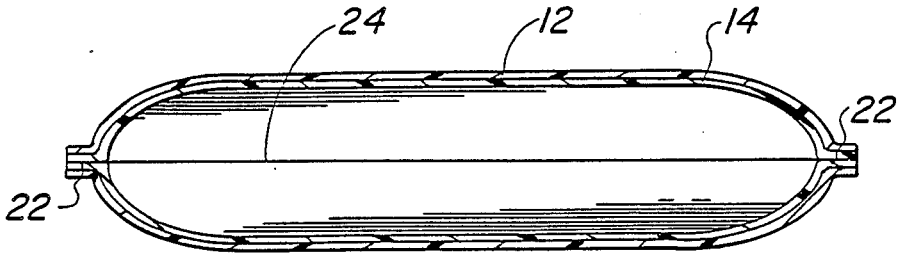
FIG. 3

FIG. 4
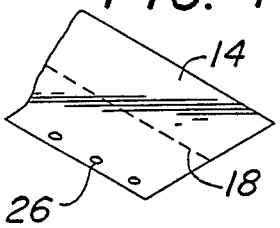
FIG. 5
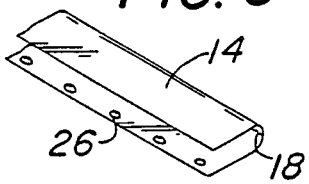
FIG. 6
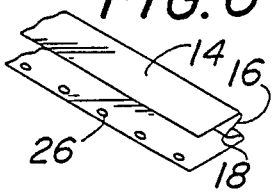
FIG. 7
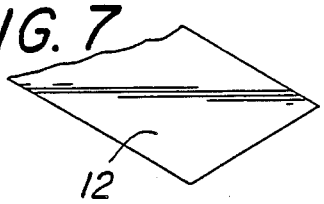
FIG. 8
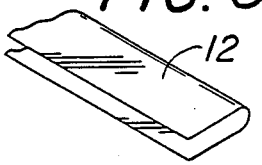
FIG. 9
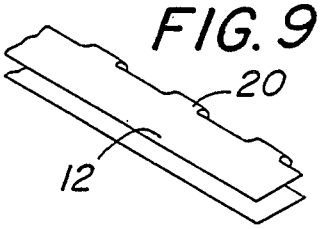
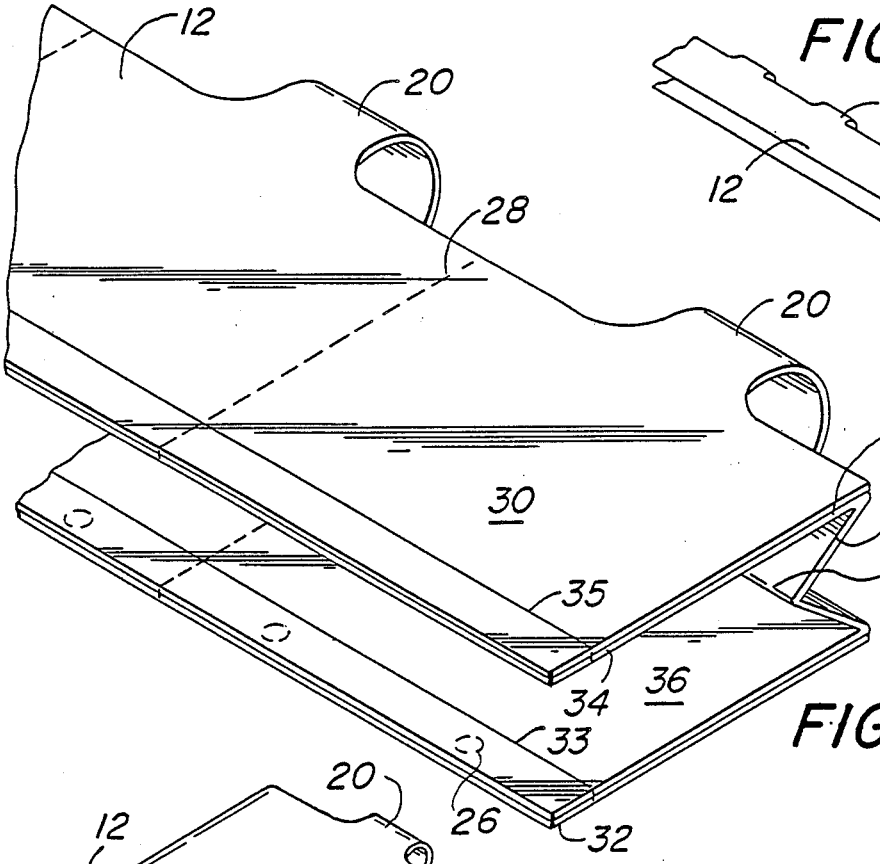
FIG. 10
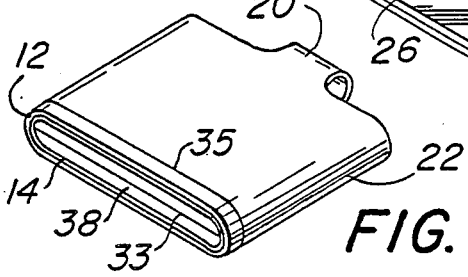
FIG. 11

FIG. 4a
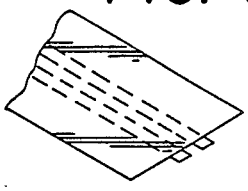
FIG. 6a
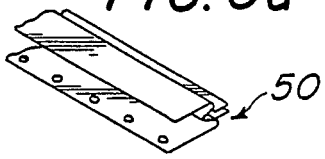
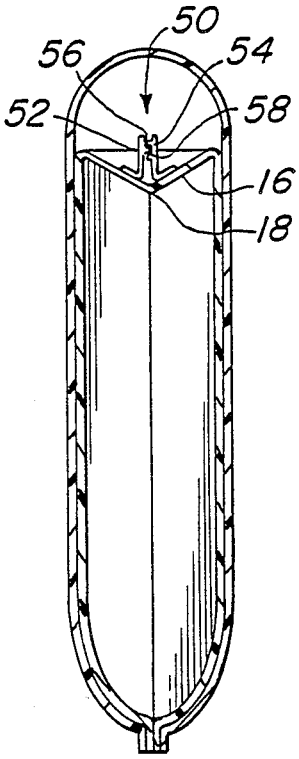
FIG. 12
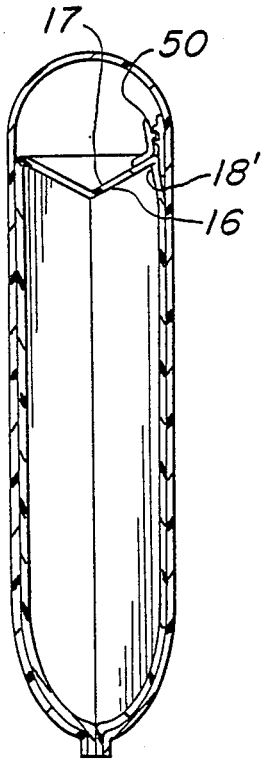
FIG. 13

BOTTOM LOADED DUPLEX BAG HAVING A HANDLE AND METHOD OF MAKING SAME

This a continuation of application Ser. No. 003,100 now abandoned; which is a continuation -in-part of application Ser. No. 821,561 filed Jan. 21, 1986 now U.S. Pat. No . 4,713,839, which is a continuation-in-part of application Ser. No. 388,381 filed June 14, 1982 now U.S. Pat. No. 4,573,203.

SCOPE OF THE INVENTION

The present invention is directed to a bottom loaded duplex bag having a handle. Also disclosed is a method for making the bag.

BACKGROUND OF THE INVENTION

U.S. Pat. No. 1,808,375 discloses a shopping bag. The shopping bag has a front and rear panels which are joined together by a handle portion. The lateral side edges and bottom are joined together.

U.S. Pat. No. 3,580,486 discloses a plastic bag having an integral strap-like handle at its upper end and a bottom gusset or satchel bottom. The gusset unfolds under the weight of the items carried in the bag.

U.S. Pat. No. 4,573,203 discloses a plastic bag having a gusset located at its upper most end adjacent a loop handle. The loop handle is welded to the bag adjacent the upper edge portion of the bag.

SUMMARY OF THE INVENTION

The present invention is directed to a duplex bag having a handle. The bag includes an inner and outer web of thermal plastic material. The outer web includes a front panel, a rear panel and a handle portion. The handle portion is integral with the front and rear panels and has a width less than the width of the front and rear panels. The inner web includes a top panel, a bottom panel and a gusset portion. The gusset portion is integral with the top and bottom panels and has a line of perforations spaced from and parallel to the top and bottom panels. All panels have about the same dimensions. The handle portion and the gusset portion are adjacent one another at a top end of the bag. The front panel overlies the top panel and the rear panel overlies the bottom panel. A side seam is formed at each lateral edge portion of said front, top, bottom, and rear panels and seals the panels together.

After the bag is filled, a bottom seam is formed at a bottom edge portion of the panels which seals the panels together. Additionally, a lip having a plurality of wicket holes may be located at the bottom edge portion of the bag. The lip having holes is used for holding the bag prior to filling and formation of the bottom seam.

DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 is an isometric view of a preferred embodiment of the present invention.

FIG. 2 is a sectional view of the bag shown in FIG. 1 taken generally along sectional lines 2—2.

FIG. 3 is a sectional view of the bag shown in FIG. 1 taken generally along lines 3—3.

FIGS. 4–6 schematically illustrate the formation of an inner web.

FIGS. 7–9 schematically illustrate the formation of an outer web.

FIG. 10 is an isometric view of the preferred embodiment prior to welding the lateral seams.

FIG. 11 is an isometric view of the preferred embodiment prior to filing and formation of the bottom seal.

FIG. 12 is a sectional view of an alternate embodiment of the present invention.

FIG. 13 is a sectional view of another alternate embodiment of the present invention.

DETAILED DESCRIPTION OF THE INVENTION

Referring to the drawings wherein like numerals indicate like elements, there is shown in FIG. 1 a preferred embodiment of the duplex bag generally designated 10.

Duplex bag 10 comprises an inner web 14 and an outer web 12. Outer web 12 includes a handle portion 20. Inner web 14 preferably includes a gusset 16. A line of perforations 18 is preferrably formed at the apex of gusset 16. The line of perforations 18 may be severed whereby materials within bag 10 may be retrieved or inserted.

The webs 12 and 14 are made of a thermal plastic material which is weldable. Webs 12 and 14 are welded together at lateral seams 22 and bottom seam 24. Seams 22 and 24 may be formed in any conventional manner such as but not limited to thermal welding, ultrasonic welding, electronic welding, etc. The seams and joints described herein may be glued, but this is not preferred.

The outer web 12 may be made of a low millage material. Regardless of the low millage material, the bag is still strong. The formation of seams 22 and 24 about the periphery of the bag 10 allows the stress at the joining points of the handle 20 and panels of web 12 to be evenly distributed over the entire web 12. Accordingly, the bag can be used for such heavy items as charcoal, fresh potatoes, diapers or sanitary products, garden products, etc.

Referring to FIGS. 4–6, the formation of inner web 14 is explained. Web 14 is generally formed from a continuous web of thermal plastic material. The line of perforation 18 may bifurcate web 14 along the longitudinal axis. The web 14 is then folded over onto itself along the line of perforations 18. See FIG. 5. Alternately, a plurality of wicket holes 26 may be disposed along a lateral edge portion or lip of web 14 parallel to the line of perforations 18. Wicket holes 26 are used for holding the bag prior to loading. If the wicket holes 26 are used, then the line of perforations is offset from the longitudinal axis and the web 14 is folded at the line 18 whereby a lip having the wicket holes 26 is formed.

After web 14 has been folded over on itself as shown in FIG. 5, gusset 16 is preferably formed along line of perforations 18 at the folded portion of the bag. The line of perforations 18 is located along the apex of gusset 16.

Referring to FIGS. 7–9, the formation of outer web 12 is disclosed. Web 12 is formed from a continuous strip of thermal plastic material. See FIG. 7. Web 12 is folded over onto itself along the longitudinal axis or can be folded over folded web 14. See FIG. 8. Handle 20 is formed along the folded portion of web 12 preferably by diecutting. Of course other methods may be used for forming the handle 20.

Referring to FIG. 10, there is an illustration of the orientation of the outer web 12 and the inner web 14 immediately prior to the welding/lateral seam formation operation.

Longitudinal welds 33 and 35 are preferably made adjacent an opening 38 of bag 10. Weld 33 joins front and top panels 30, 34. Weld 35 joins rear and bottom panels 32, 36. Welds 33, 35 are made in any well known manner. Welds 33, 35 prevent materials, added to bag 10 during loading, from falling between the panels of the inner and outer panels.

Web 12 includes a front panel 30 and a rear panel 32 which are joined together by handle portion 20. Front panel 30 and rear panel 32 are preferably rectangular and have the same general dimensions. The handle portion 20 has a width which is preferably narrower than the width of the front and rear panels 30 and 32.

Inner web 14 comprises a top panel 34, a bottom panel 36 and the gusset portion 16. Gusset portion 16 is integral with and joins top and bottom panels 34 and 36. Top and bottom panels 34 and 36 are preferably rectangular and have the same general dimensions.

Front and rear panels 30 and 32 and top and bottom panels 34 and 36 all preferably have the same general dimensions.

Front panel 30 overlies top panel 34. Rear panel 32 overlies bottom panel 36. Handle portion 20 and gusset portion 16 are adjacent a top portion of the bag.

Lateral seams 22 are formed along seam line 28. Seam line 28 is generally perpendicular to perforated line 18. The welding operation which forms lateral seams 22 severs one bag 10 from the next and seals the panels 30, 34, 36 and 32 together.

FIG. 11 shows a preferred embodiment of the present invention prior to the formation of a bottom seam 24. Bag 10 includes a bottom opening 38. Materials are filed into bag 10 via opening 38. If the embodiment having the lip and wicket holes 26 is utilized, then during the formation of the bottom seal 26 the lip is severed from the bag 10.

FIGS. 12 and 13 illustrate two alternate embodiments of the present invention in which a closure means 50 is attached adjacent to the gusset 16. The closure means 50 includes a male member 52 and a female member 54. The male and female members 52, 54 may be joined together thereby forming a seal which closes the bag. Male and female members 52, 54 may be separated thereby allowing access to the bag. Male member 52 includes a longitudinal rib 56 which is adapted for a press-lock fit in a groove 58 of female member 54.

The embodiment illustrated in FIG. 12 has the closure means 50 straddling perforated line 18. The male member 52 is welded to a portion of the gusset 16 on one side of line 18 and female member 54 is welded to a portion of the gusset 16 on the other side of line 18. After the bag 10 is loaded and opening 18 is sealed, the closure means 50 can be opened and perforated line 18 separated. This allows access into the gag. The closure means 50 can be sealed, thereby closing the bag. The method of making the bag illustrated in FIG. 12 is generally the same as discussed above. However, the closure means 50 may be joined to the inner web 14 prior to the first folding step. (See FIG. 4*a*). The male and female members 52, 54 are joined to web 14 on either side of the perforated line 18 in any conventional manner.

The embodiment illustrated in FIG. 13 is generally the same as the embodiment of FIG. 12. However, the closure means 50 (the same as previously described) is adjacent the front (or rear) panel. The perforated line 18 is eliminated and new perforated line 18' is formed. One member of the closure means 50 is welded to a side 17 of gusset 16. The other member of the closure means 50 is welded to the panel of the inner web and is between panels of the inner and outer web. The method of making this embodiment is generally the same as the originally described method. However, the closure means 50 may be joined to the inner web after or with the formation of the gusset 16. (See FIG. 6*a*).

The present invention may be embodied in other specific forms without departing from the spirit or essential attributes thereof and, accordingly, reference should be made to the appended claims, rather than to the foregoing specification, as indicating the scope of the invention.

I claim:

1. A duplex bag, comprising:

top and bottom end portions;

an inner bag for storing product and an outer bag for supporting the inner bag, the inner and outer bags being respectively made of discrete inner and outer webs of thermal plastic material;

the outer bag including a front panel, a rear panel and handle portion connecting the panels together;

the inner bag including a front panel, a rear panel and a fold portion connecting the last-mentioned panels together;

said outer bag handle portion straddling said inner web fold portion at the top end portion of the duplex bag, the outer bag otherwise being open at the top end portion of the duplex bag;

said inner bag being open along the bottom end portion of the duplex bag to facilitate introduction of product into the inner bag.

2. The bag according to claim 1 wherein all panels are generally rectangular.

3. The bag according to claim 1 wherein the outer panel is a low millage material.

4. The bag according to claim 1 further comprising a lip having a hole, the lip being integral with the inner web and located at an end of the bag opposed to the gusset portion.

5. The bag according to claim 1 further comprising a longitudinal seam joining said front panels and a longitudinal seam joining said rear panels, said longitudinal seams being formed adjacent said bottom end portion of said duplex bag.

6. The bag according to claim 1 further comprising a closure means including a male member and a female member, said closure means being joined to said inner web adjacent said fold portion.

7. The bag according to claim 1 wherein said fold portion is provided with perforations for facilitating access to product stored in the inner bag and further comprising a closure means joined to said inner web and straddling said perforations.

8. The bag according to claim 1 wherein the inner web fold portion is a gusset.

9. The bag according to claim 1 further comprising perforations formed in the fold portion for facilitating access to product stored in the inner bag.

10. A duplex bag, comprising:

a top end portion and a bottom end portion and side portions extending therebetween, an inner bag for storing product, an outer bag for supporting the inner bag, said inner and outer bags being made of flexible plastic material, the inner bag having front and rear panels and a fold portion connecting the panels at the top end portion of the duplex bag, the outer bag having front and rear panels and a loop handle portion connecting the last-mentioned panels along the top end portion of the duplex bag such that said loop handle portion straddles said inner bag fold portion, the outer bag otherwise being open at the top end portion of the duplex bag, each panel having first and second side edges along the side portions of the duplex bag and a bottom edge along the bottom end portion of the duplex bag, said inner and outer panels being connected together along said first and second side edges thereof such that said side portions of the duplex bag are closed, said front panels being separated from said rear panels such that said bottom edge portion of the duplex bag is open to facilitate loading the inner bag with product through the bottom end portion of the duplex bag.

11. A bag according to claim 1 wherein said inner web is a unitary piece of thermal plastic material.

12. The bag according to claim 1 wherein said outer web is a unitary piece of thermal plastic material.

13. The duplex bag according to claim 10 wherein said inner bag fold portion is in the form of a gusset.

14. The duplex bag according to claim 10 wherein said front panels are connected together near said bottom edges thereof and said rear panels are connected together along said bottom edges thereof.

15. A duplex bag, comprising:

a top end portion and a bottom end portion and side portions extending therebetween, an inner bag for storing product, an outer bag for supporting the inner bag, said inner and outer bags being made of flexible plastic material, the inner bag having front and rear panels and a fold portion connecting the panels at the top end portion of the duplex bag, the outer bag having front and rear panels and a loop handle portion connecting the last-mentioned panels along the top end portion of the duplex bag such that said outer bag loop handle portion straddles said inner bag fold portion, the outer bag otherwise being open at the top end portion of the duplex bag, each panel having first and second side edges along the side portions of the duplex bag and a bottom edge along the bottom end portion of the duplex bag, said inner and outer panels being connected together along said first and second side edges thereof and along said bottom edge thereof such that said side portions and said bottom end portion of the duplex bag are closed whereby the inner bag may be carried when filled by lifting the outer bag along the handle portion thereof.

16. The duplex bag according to claim 15 wherein said inner bag fold portion is in the form of a gusset.

17. The duplex bag according to claim 15 wherein said front panels are connected together along said bottom edges thereof and said rear panels are connected together along said bottom edges thereof.

18. The duplex bag according to any one of claims 1, 10 and 15 wherein each of said inner and outer bags is made of a unitary web of material.

19. A method of making the duplex bag comprising the steps of:

providing an inner web of thermal plastic material;

forming a fold portion in said inner web;

providing an outer web of thermal plastic material;

forming a fold portion in said outer web;

forming a handle portion at the fold portion of said outer web;

joining the folded inner web and the folded outer web such that the inner web forms an inner bag with an open end portion and the outer web forms an outer bag with an open end portion, the handle portion of the outer web straddling the fold portion of the inner web.

20. A method according to claim 5 further comprising the step of:

forming a gusset at the folded portion of the inner web.

21. A method according to claim 25 further comprising forming perforations along the fold portion of the inner web.

22. A method according to claim 19 further comprising the steps of:

loading the inner bag with product; and welding a bottom seam which joins the inner and outer webs together to seal said open end portions of the inner and outer bags.

23. The method according to claim 19 further comprising the steps of:

forming a longitudinal weld whereby the inner and outer webs are joined together adjacent said open end portions of said inner and outer bags.

24. The method according to claim 19 further comprising the step of:

joining a closure means to said inner web adjacent said folded portion.

25. The method according to claim 21 further comprising the step of:

joining a closure means to said inner web adjacent said fold portion and straddling said perforations.

* * * * *